US009989884B2

(12) United States Patent
Isoda

(10) Patent No.: US 9,989,884 B2
(45) Date of Patent: Jun. 5, 2018

(54) TONER AMOUNT DETECTION SENSOR

(71) Applicant: KYOCERA Document Solutions Inc., Osaka-shi, Osaka (JP)

(72) Inventor: Keisuke Isoda, Osaka (JP)

(73) Assignee: KYOCERA DOCUMENT SOLUTIONS INC., Osaka-shi, Osaka (JP)

( * ) Notice: Subject to any disclaimer, the term of this patent is extended or adjusted under 35 U.S.C. 154(b) by 0 days. days.

(21) Appl. No.: 15/491,999

(22) Filed: Apr. 20, 2017

(65) Prior Publication Data

US 2017/0308002 A1 Oct. 26, 2017

(30) Foreign Application Priority Data

Apr. 22, 2016 (JP) ..... 2016-085953

(51) Int. Cl.
*G03G 15/08* (2006.01)

(52) U.S. Cl.
CPC ..... *G03G 15/0827* (2013.01)

(58) Field of Classification Search
CPC ..... G03G 15/0827
See application file for complete search history.

(56) References Cited

U.S. PATENT DOCUMENTS 4,950,905 A * 8/1990 Butler ..... G01N 21/474 250/341.8
5,630,195 A * 5/1997 Sawayama ..... G03G 15/0855 399/49
7,676,169 B2 * 3/2010 Denton ..... G03G 15/5062 399/49
8,918,005 B2 * 12/2014 Ogata ..... H04N 5/335 356/445
2009/0297191 A1 * 12/2009 Hirai ..... G03G 15/1605 399/49

FOREIGN PATENT DOCUMENTS

JP H10-281991 A 10/1998
JP 2011-170165 A 9/2011

* cited by examiner

*Primary Examiner* — David Bolduc

(57) ABSTRACT

A toner amount detection sensor has a first light receiving element, a second light receiving element, and a toner amount calculation unit. The first light receiving element is provided on a side opposite to a light emitting element with respect to a plane extending in a direction perpendicular to a surface of a transfer belt. The second light receiving element is provided at a position avoiding a plane containing the light emitting element and the first light receiving element and is provided separately from the first light receiving element. The toner amount calculation unit calculates the toner amount from the light quantity of the light equivalent to the specular reflection light received by the first light receiving element and the light quantity of the diffuse-reflected light received by the second light receiving element.

10 Claims, 9 Drawing Sheets

TONER AMOUNT DETECTION SENSOR

INCORPORATION BY REFERENCE

This disclosure of Japanese Patent Application No. 2016-085953 filed on Apr. 22, 2016 including the specification, drawings and abstract is incorporated herein by reference in its entirety.

BACKGROUND

This disclosure relates to a toner amount detection sensor and an image forming apparatus.

In an image forming apparatus typified by a multifunctional peripheral and the like, an image of a document is read by an image reading unit, and then a photoconductor provided in an image forming unit is irradiated with light based on the read image to form an electrostatic latent image on the photoconductor. Thereafter, a developing agent, such as a charged toner, is supplied onto the formed electrostatic latent image to form a visible image, the visible image is transferred and fixed to a fed sheet, and then the sheet is discharged to the outside of the apparatus.

Herein, in a certain image forming apparatus capable of forming a full color image, yellow, cyan, magenta, and black colors are overlapped to form a full color image. In this case, a toner of each color is once transferred to a transfer belt as an intermediate transfer body, and then a full color image is transferred to a sheet. In the formation of the full color image, it is necessary to perform correction at predetermined timing in order to maintain color development properties and color reproducibility. In the correction, the toner amount on the transfer body is detected, and then adjustment of a development bias value, adjustment of the exposure amount, adjustment of exposure timing, and the like are performed so that a proper toner amount is set.

Herein, a technique on a sensor detecting the toner amount is known from the past.

According to a former typical gloss sensor, the glossiness is measured by irradiating the surface of an object with measuring light having a predetermined angle of incidence with a projector, and then measuring a reflected light from the object surface with a light receiving unit at the reflection angle which is the same angle as the angle of incidence. Such a gloss sensor has a feature in that the projector emits a single wavelength and a polarization device is provided, so that the object surface is irradiated with light having polarization in a single direction, a reflected light from the object surface is caused to transmit through a polarization beam splitter to be thereby divided into a reflected light component having polarization in the same direction as that of the measuring light and a reflected light component having a direction different therefrom, each reflected light component is measured by light receiving means provided to each reflected light component, and then the outputs from the two light receiving means are calculated to measure the glossiness.

A former typical image forming apparatus has a recording medium conveying belt which is rotatably stretched by a plurality of roller members. In such an image forming apparatus, at least one or more specular reflection light detection type optical sensors and at least one or more specular reflection light/scattering light simultaneous detection type optical sensors are disposed facing an intermediate transfer body and at least one or more specular reflection light detection type optical sensors are disposed facing the recording medium conveying belt or a second image carrying body. Such an image forming apparatus performs black toner adhesion amount control using the at least one or more specular reflection light detection type optical sensors disposed facing the recording medium conveying belt or the second image carrying body and the adhesion amount control of toners other than the black toner is performed using the at least one or more specular reflection light/scattering light simultaneous detection type optical sensors disposed facing the intermediate transfer body. Furthermore, such an image forming apparatus has a feature of performing each color alignment using the at least one or more specular reflection light/scattering light simultaneous detection type optical sensors disposed facing the intermediate transfer body and the at least one or more specular reflection light detection type optical sensors.

SUMMARY

In one aspect of this disclosure, a toner amount detection sensor detects the toner amount of a visible image by toner formed on the surface of a transfer body. The toner amount detection sensor has a light emitting element, a first light receiving element, a second light receiving element, and a toner amount calculation unit. The light emitting element emits light to the surface side of the transfer body at a predetermined angle of incidence. The first light receiving element is provided on a side opposite to the light emitting element with respect to the plane extending in a direction perpendicular to the surface of the transfer body. The first light receiving element receives light equivalent to a specular reflection light reflected from the surface side of the transfer body. The second light receiving element is provided at a position avoiding the plane containing the light emitting element and the first light receiving element and is provided separately from the first light receiving element. The second light receiving element receives a diffuse-reflected light which is diffuse-reflected from the surface side of the transfer body. The toner amount calculation unit calculates the toner amount from the light quantity of the light equivalent to the specular reflection light received by the first light receiving element and the light quantity of the diffuse-reflected light received by the second light receiving element.

In another aspect of this disclosure, an image forming apparatus forms a visible image by toner and has a toner amount detection sensor detecting the toner amount of the visible image by toner formed on the surface of a transfer body. The toner amount detection sensor detects the toner amount of the visible image by toner formed on the surface of the transfer body. The toner amount detection sensor has a light emitting element, a first light receiving element, a second light receiving element, and a toner amount calculation unit. The light emitting element emits light to the surface side of the transfer body at a predetermined angle of incidence. The first light receiving element is provided on a side opposite to the light emitting element with respect to the plane extending in a direction perpendicular to the surface of the transfer body. The first light receiving element receives light equivalent to a specular reflection light reflected from the surface side of the transfer body. The second light receiving element is provided at a position avoiding the plane containing the light emitting element and the first light receiving element and is provided separately from the first light receiving element. The second light receiving element receives a diffuse-reflected light which is diffuse-reflected from the surface side of the transfer body. The toner amount calculation unit calculates the toner amount from the light quantity of the light equivalent to the specular reflection light received by the first light receiving element and the light quantity of the diffuse-reflected light received by the second light receiving element.

DETAILED DESCRIPTION

Figure 1:
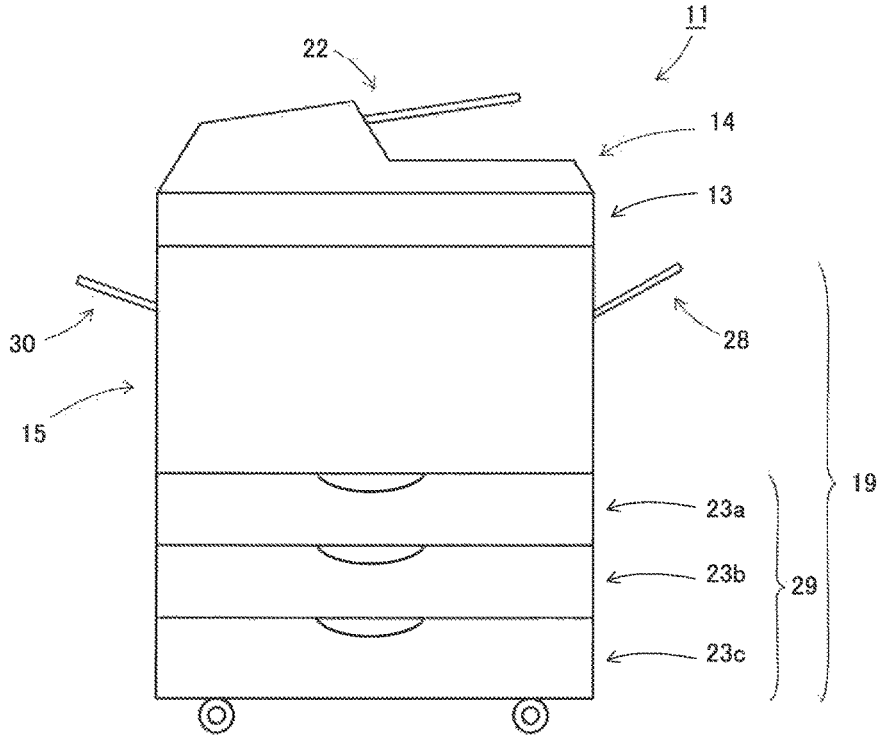
FIG. 1 is a schematic view illustrating the appearance of a digital multifunctional peripheral when an image forming apparatus according to one embodiment of this disclosure is applied to the digital multifunctional peripheral.
Figure 2:
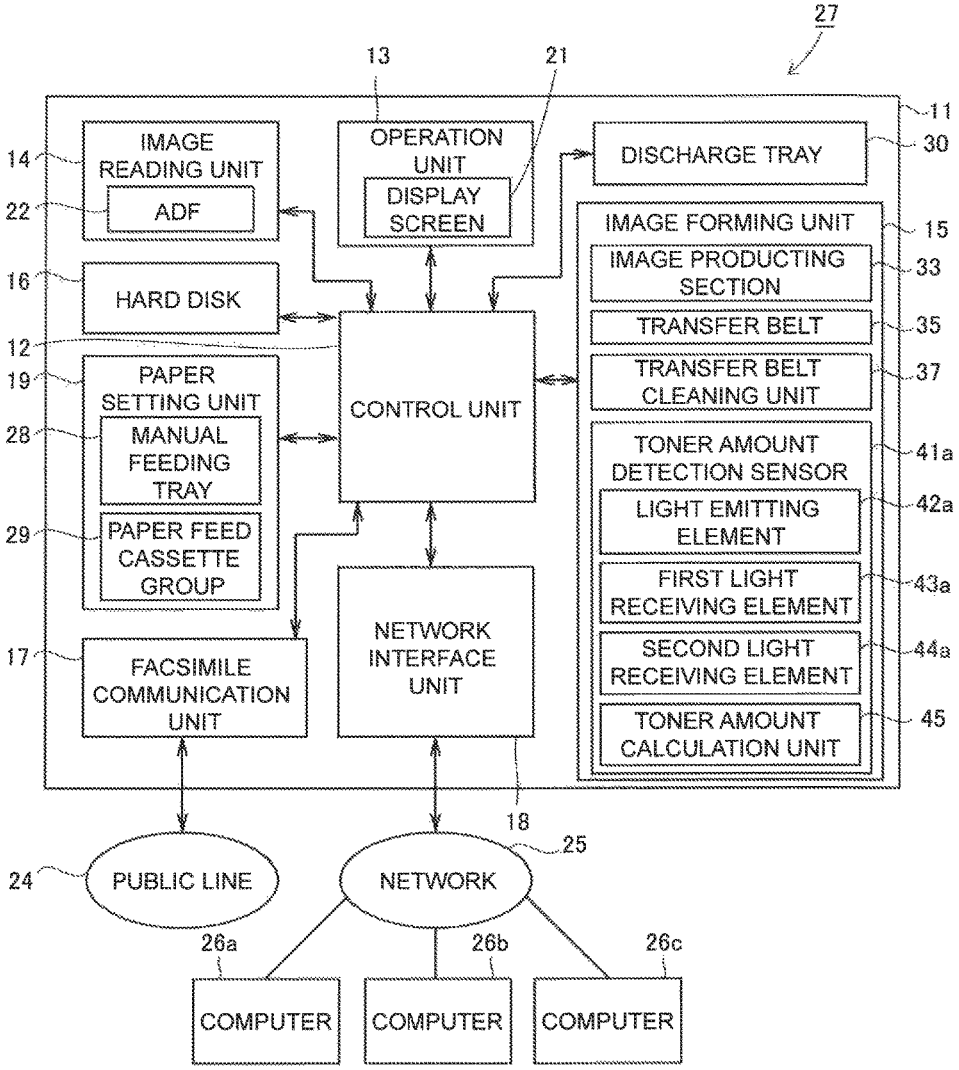
FIG. 2 is a block diagram illustrating the configuration of the digital multifunctional peripheral when the image forming apparatus according to one embodiment of this disclosure is applied to the digital multifunctional peripheral.

Hereinafter, an embodiment of this disclosure is described. First, the configuration of a digital multifunctional peripheral when an image forming apparatus according to one embodiment of this disclosure is applied to the digital multifunctional peripheral is described. FIG. 1 is a schematic view illustrating the appearance of a digital multifunctional peripheral when an image forming apparatus according to one embodiment of this disclosure is applied to the digital multifunctional peripheral. FIG. 2 is a block diagram illustrating the configuration of the digital multifunctional peripheral when the image forming apparatus according to one embodiment of this disclosure is applied to the digital multifunctional peripheral.

With reference to FIG. 1 and FIG. 2, a digital multifunctional peripheral 11 contains a control unit 12 controlling the entire digital multifunctional peripheral 11 and a display screen 21 displaying information transmitted from the digital multifunctional peripheral 11 side and the contents of an input of a user, and the digital multifunctional peripheral 11 has an operation unit 13 causing a user to input image formation conditions, such as the number of prints and gradation, and ON or OFF of the power supply, an image reading unit 14 contains an ADF (Auto Document Feeder) 22 which automatically conveys a set document to a reading unit and reads an image of the document, a paper setting unit 19 which contains a manual feeding tray 28 to which paper is manually set and a paper feed cassette group 29 capable of storing a plurality of sheets different in size and which sets a sheet to be fed to an image forming unit 15, the image forming unit 15 forms an image based on a read image or image data transmitted through a network 25, a discharge tray 30 discharging a sheet after forming an image on the sheet by the image forming unit 15, a hard disk 16 storing the transmitted image data, the input image formation conditions, and the like, a facsimile communication unit 17 which is connected to a public line 24 and performs facsimile transmission and facsimile reception, and a network interface unit 18 for performing connection with the network 25. The digital multifunctional peripheral 11 has a DRAM (Dynamic Random Access Memory) writing and reading-out image data and the like but illustration and a description thereof is omitted. The arrows in FIG. 2 indicate the flow of control signals and data on control and images. As illustrated in FIG. 1, the paper feed cassette group 29 is configured from three paper feed cassettes 23*a*, 23*b*, and 23*c* in this embodiment.

The digital multifunctional peripheral 11 operates as a copying machine by forming an image in the image forming unit 15 using a document read by the image reading unit 14. The digital multifunctional peripheral 11 operates as a printer by forming an image in the image forming unit 15, and then printing the image on a sheet using image data transmitted from computers 26*a*, 26*b*, and 26*c* connected to the network 25 through the network interface unit 18. More specifically, the image forming unit 15 operates as a printing unit which prints a requested image. The digital multifunctional peripheral 11 operates as a facsimile device by forming an image in the image forming unit 15 through the DRAM using image data transmitted from the public line 24 through the facsimile communication unit 17 and transmitting image data of a document read by the image reading unit 14 to the public line 24 through the facsimile communication unit 17. The digital multifunctional peripheral 11 has a plurality of functions relating to image processing, such as a copying function, a printer function, and a facsimile function. Furthermore, the digital multifunctional peripheral 11 has a function capable of setting each function in detail.

An image formation system 27 containing the digital multifunctional peripheral 11 according to one embodiment of this disclosure has the digital multifunctional peripheral 11 of the configuration described above and the plurality of computers 26*a*, 26*b*, and 26*c* connected to the digital multifunctional peripheral 11 through the network 25. In this embodiment, three computers are illustrated as the plurality of computers 26*a* to 26*c*. Each of the computers 26*a* to 26*c* can perform printing by performing a print request through the network 25 to the digital multifunctional peripheral 11. Configurations may be acceptable in which the digital multifunctional peripheral 11 and the computers 26*a* to 26*c* are connected through wire using a LAN (Local Area Network) cable or the like or connected by radio and another digital multifunctional peripheral and a server are connected in the network 25.

Figure 3:
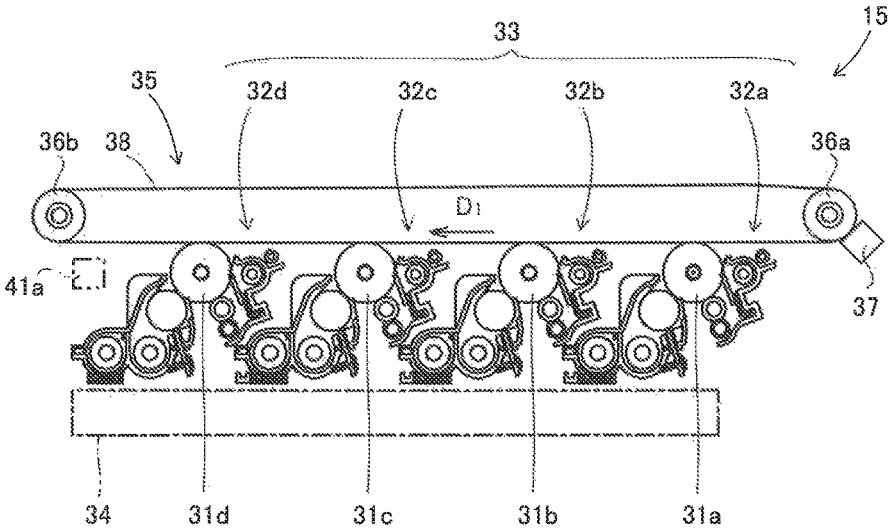
FIG. 3 is an outside view illustrating the schematic configuration of an image forming unit.

Next, the configuration of the image forming unit 15 provided in the digital multifunctional peripheral 11 is described in more detail. FIG. 3 is a cross-sectional view illustrating the schematic configuration of the digital multifunctional peripheral 11 according to one embodiment of this disclosure. In FIG. 3, hatching of members is omitted from the viewpoint of ease of understanding. FIG. 3 is a cross-sectional view when the digital multifunctional peripheral 11 is cut along the plane extending in the vertical direction.

With reference to FIG. 3, the image forming unit 15 contains photoconductors 31*a*, 31*b*, 31*c*, and 31*d*, and the image forming unit 15 has an image producing section 33 containing four image producing units 32*a*, 32*b*, 32*c*, and 32*d* corresponding to four colors of yellow, magenta, cyan, and black, respectively, an LSU (Laser Scanner Unit) 34 exposing light to the four image producing units 32*a* to 32*d* based on the image read by the image reading unit 14, a transfer belt 35 as an intermediate transfer body to which a visible image by toner formed by the image producing units 32*a* to 32*d* is temporarily transferred before transferred to a sheet, and a transfer belt cleaning unit 37 removing a toner remaining on the transfer belt 35 with a blade or the like. The LSU 34 is schematically illustrated by the alternate long and short dash lines. The transfer belt cleaning unit 37 is also schematically illustrated. The image forming unit 15 has a so-called quadruple tandem type development system.

The transfer belt 35 has an endless shape and transfers a visible image formed by the image producing units 32*a* to 32*d* of four colors of yellow, magenta, cyan, and black, respectively, while rotating in one direction by a driving roller 36*b* and a driven roller 36*a*. The rotation direction of the transfer belt 35 is indicated by the arrow $D_1$ in FIG. 3. Among the image producing units 32*a* to 32*d*, the yellow image producing unit 32*a* is disposed on the most upstream side and the black image producing unit 32*d* is disposed on the most downstream side in the rotation direction of the transfer belt 35. The transfer belt cleaning unit 37 is disposed on the upstream side of the yellow image producing unit 32*a*.

The visible image by toner transferred onto the transfer belt 35 is transferred to the conveyed sheet, and then fixed to the sheet by a fixing unit which is not illustrated. After the fixing, the sheet is discharged to the outside of the digital multifunctional peripheral 11, specifically discharged to the discharge tray 30. After the visible image by toner is transferred to the sheet, the toner remaining on the transfer belt 35 is removed by the transfer belt cleaning unit 37. Then, next image formation is performed.

The digital multifunctional peripheral 11 can perform monochrome printing using only the black image producing unit 32*d*. The digital multifunctional peripheral 11 can perform color printing using at least any one of the yellow image producing unit 32*a*, the magenta image producing unit 32*b*, and the cyan image producing units 32*c*.

Herein, the control unit 12 provided in the digital multifunctional peripheral 11 corrects the concentration, the position, and color shift of the visible image to be formed on the transfer belt 35 by the image producing units 32*a* to 32*d*, for example, at the timing when the number of printed sheets has reached a predetermined number of sheets, specifically at every timing when the number of sheets of image formation has reached 1000 sheets, at the timing when the drive time has reached a predetermined time, at the timing when the environmental change has occurred, specifically at the timing when the temperature or the humidity has dramatically changed, or at the timing of exchanging some of the units configuring the digital multifunctional peripheral 11. The image forming unit 15 forms a patch image for correcting the visible image by toner on the transfer belt 35 when a periodical maintenance is performed, for example. Then, the amount of a toner to be given to the transfer belt 35, the timing when laser light is emitted by LSU 34, the intensity, and the like are changed using the patch image to adjust the concentration of the toner, the color shift, and the like to perform the correction. The formed patch image is not transferred to a sheet and is removed from a surface 38 of the transfer belt 35 by the transfer belt cleaning unit 37.

In such correction, a toner amount detection sensor detecting the toner amount of the patch image formed on the transfer belt 35 is used. More specifically, the image forming unit 15 has a toner amount detection sensor 41*a* measuring the toner amount of the visible image by toner transferred onto the transfer belt 35.

Figure 4:
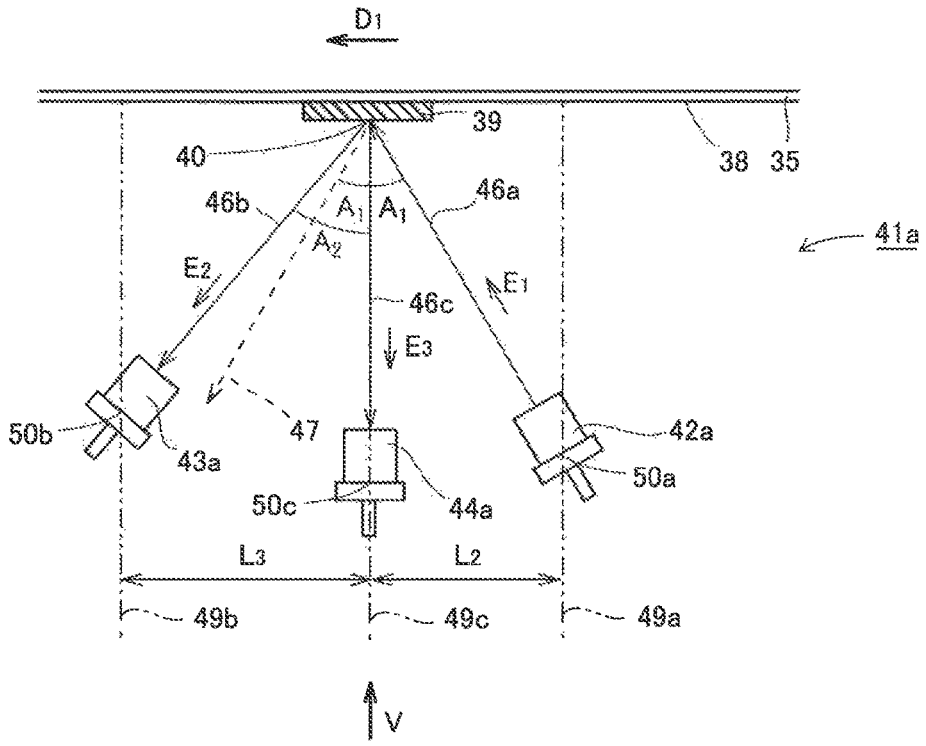
FIG. 4 is an outside view illustrating the schematic configuration of a toner amount detection sensor according to one embodiment of this disclosure.
Figure 5:
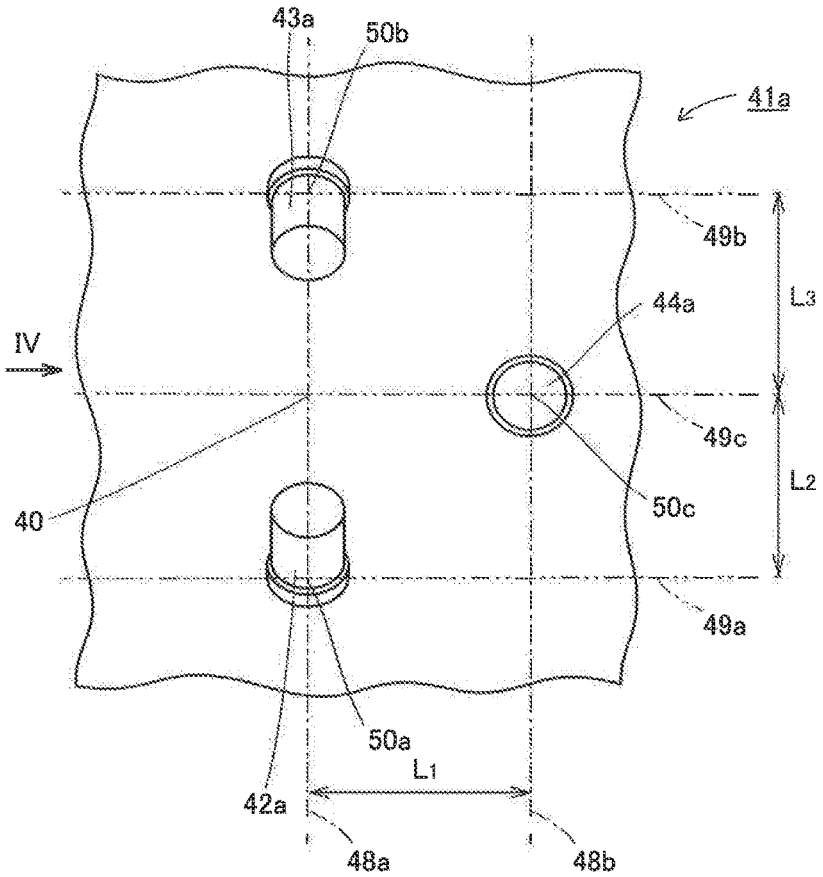
FIG. 5 is a view of the toner amount detection sensor illustrated in FIG. 4 as viewed from the direction indicated by the arrow V in FIG. 4.

Next, the configuration of the toner amount detection sensor 41*a* according to one embodiment of this disclosure is described. FIG. 4 is a schematic view illustrating the configuration of the toner amount detection sensor 41*a* according to one embodiment of this disclosure. FIG. 5 is a view of the toner amount detection sensor 41*a* illustrated in FIG. 4 as viewed from the direction indicated by the arrow V in FIG. 4. In FIG. 3, the toner amount detection sensor 41*a* is schematically illustrated by the chain double-dashed lines. FIG. 4 is a view as viewed from the direction indicated by the arrow IV in FIG. 5.

With reference to FIG. 1 to FIG. 5, the toner amount detection sensor 41*a* is disposed on the downstream side of the black image producing unit 32*d*. The toner amount detection sensor 41*a* has a light emitting element 42*a* emitting light to the transfer belt 35 side, a first light receiving element 43*a* receiving a specular reflection light reflected from the surface 38 side of the transfer belt 35, a second light receiving element 44*a* which is provided separately from the first light receiving element 43*a* and receives a diffuse-reflected light which is diffuse-reflected from the surface 38 side of the transfer belt 35, and a toner amount calculation unit 45 calculating the toner amount from the light quantity of the specular reflection light received by the first light receiving element 43*a* and the light quantity of the diffuse-reflected light received by the second light receiving element 44*a*. As an example of the light emitting element 42*a*, an infrared light emitting diode emitting infrared light is specifically employed. As an example of the first light receiving element 43*a* and the second light receiving element 44*a*, an infrared light receiving unit is specifically employed.

The light emitting element 42*a* emits a light 46*a*, such as infrared light, in the obliquely upper left direction indicated by the arrow $E_1$ in FIG. 4 toward the surface 38 of the transfer belt 35 or the visible image 39 by toner. In the emission f the light 46*a*, the light 46*a* is emitted at an angle of incidence $A_1$ illustrated in FIG. 4. The angle $A_1$ is an angle formed by a plane 49*c* extending in a direction perpendicular to the surface 38 of the transfer belt 35 and the emission direction of the light 46*a* at an emission position 40 of the light 46*a*. The plane 49*c* is illustrated by the chain double-dashed lines. In this embodiment, the angle $A_1$ is also an angle at which the light emitting element 42*a* is disposed with respect to the plane 49*c*. The angle $A_1$ is preferably relatively smaller from the viewpoint of reducing the fluctuation of output values of the first and second light receiving elements 43*a* and 44*a* as small as possible to the fluctuation of the distance between the measurement target and the light emitting element 42*a*. For example, the angle $A_1$ preferably falls within the range of 10° or more and less than 12°, and, specifically, $A_1$=11° is selected. A plane 49*a* which is parallel to the plane 49*c* and contains a position 50*a* where the light emitting element 42*a* is provided is illustrated by the chain double-dashed lines.

The first light receiving element 43*a* is provided on the side opposite to the light emitting element 42*a* with respect to the plane 49*c* extending in a direction perpendicular to the surface 38 of the transfer belt 35. The first light receiving element 43*a* receives either a light 46*b* equivalent to equivalent to the specular reflection light from the visible image 39 by toner traveling toward the obliquely lower left direction indicated by the arrow $E_2$ in FIG. 4 or a light 46*b* equivalent to the specular reflection light from the surface 38 of the transfer belt 35 or a light 46*b* equivalent to the specular reflection light from both the visible image 39 by toner and the surface 38 of the transfer belt 35. When the visible image 39 by toner completely covers the surface 38 of the transfer belt 35, only the light 46*b* equivalent to the specular reflection light from the visible image 39 by toner is received. Unless the visible image 39 by toner is formed on the surface 38 of the transfer belt 35, only the light 46*b* equivalent to the specular reflection light from the surface 38 of the transfer belt 35 is received. When the visible image 39 by toner does not completely cover the surface 38 of the transfer belt 35 and the toner amount of the visible image 39 by toner is small, the light 46*b* equivalent to the specular reflection light from both the visible image 39 by toner and the surface 38 of the transfer belt 35 is received. In receiving the light 46*b* equivalent to the specular reflection light, the light 46*b* equivalent to the specular reflection light is received at the angle $A_2$ illustrated in FIG. 4. In this embodiment, the angle $A_2$ is an angle at which the first light receiving element 43 is disposed with respect to the plane 49*c*. For reference, the direction of the specular reflection light specular reflected at the angle $A_1$ is illustrated by dashed lines 47. A plane 49*b* which is parallel to the plane 49*c* and contains a position 50*b* at which the first light receiving element 43*a* is provided is illustrated by the chain double-dashed lines. A plane 48*a* containing the light emitting element 42*a* and the first light receiving element 43*a* is illustrated by the alternate long and short dash lines in FIG. 5. The position where the plane 48*a* and the plane 49*c* cross serves as the emission position 40 of the light 46*a* and the reflection position of the light 46*a*.

It is configured so that, when a predetermined angle of incidence to the plane 49*c* extending in the direction perpendicular to the surface 38 of the transfer belt 35 at the emission position 40 is defined as the angle $A_1$ and the angle at which the first light receiving element 43*a* is disposed with respect to the plane 49*c* extending in the direction perpendicular to the surface 38 of the transfer belt 35 at the emission position 40 is disposed is defined as the angle $A_2$, a relationship of $A_1<A_2<1.5A_1$ is established. The angle $A_2$ preferably falls within the range of 12° or more and less than 18°, and, specifically, $A_2=13°$ is selected, for example.

The second light receiving element 44*a* receives either a diffuse-reflected light 46*c* from the visible image 39 by toner traveling toward the downward direction indicated by the arrow $E_3$ in FIG. 4 or a diffuse-reflected light 46*c* from the surface 38 of the transfer belt 35 or a diffuse-reflected light 46*c* from both the visible image 39 by toner and the surface 38 of the transfer belt 35. When the visible image 39 by toner completely covers the surface 38 of the transfer belt 35, only the diffuse-reflected light 46*c* from the visible image 39 by toner is received. Unless the visible image 39 by toner is formed on the surface 38 of the transfer belt 35, only the diffuse-reflected light 46*c* from the surface 38 of the transfer belt 35 is received. When the visible image 39 by toner does not completely cover the surface 38 of the transfer belt 35 and the toner amount of the visible image 39 by toner is small, the diffuse-reflected light 46*c* from both the visible image 39 by toner and the surface 38 of the transfer belt 35 is received. The plane 49*c* is parallel to the planes 49*a* and 49*b* and contains a position 50*c* at which the second light receiving element 44*a* is provided.

Herein, the second light receiving element 44*a* is provided at a position avoiding the plane 48*a* containing the light emitting element 42*a* and the first light receiving element 43*a*. Specifically, with reference to FIG. 5, the second light receiving element 44*a* is provided on a plane 48*b* which is parallel to the plane 48*a* containing the light emitting element 42*a* and the first light receiving element 43*a* and is disposed in parallel to the plane 48*a*. The plane 48*b* is also illustrated by the alternate long and short dash lines. The length between the plane 48*a* and the plane 48*b* is indicated by a length $L_1$ in FIG. 5. The length between the plane 49*a* and the plane 49*c* is indicated by a length $L_2$. The length between the plane 49*a* and the plane 49*c* is indicated by a length $L_3$. More specifically, as illustrated in FIG. 4, the second light receiving element 44*a* is located between the light emitting element 42*a* and the first light receiving element 43*a* in the horizontal direction.

The toner amount detection sensor 41*a* irradiates the transfer belt 35 on the surface 38 of which the visible image 39 by toner is formed with the light 46*a* in the direction indicated by the arrow $E_1$ in FIG. 4. The light 46*a* hits either or both of the visible image 39 by toner and the surface 38 of transfer belt 35 to be reflected. Among the reflected lights, the light 46*b* equivalent to a specular reflection light is received by the first light receiving element 43*a* disposed at an angle tilted by the angle $A_2$ with respect to the plane 49*c*. Among the reflected lights, a diffuse-reflected light is received by the second light receiving element 44*a* provided at the position avoiding the plane 48*a* containing the light emitting element 42*a* and the first light receiving element 43*a*. The first light receiving element 43*a* and the second light receiving element 44*a* each output a current corresponding to the light quantity of the received light. The toner amount calculation unit 45 converts the current output by each of the first light receiving element 43*a* and the second light receiving element 44*a* to a voltage. Then, the toner amount is calculated based on these voltage values. Thus, the toner amount detection sensor 41*a* detects the toner amount.

Since the second light receiving element 44*a* is provided at the position avoiding the plane 48*a* containing the light emitting element 42*a* and the first light receiving element 43*a*, such a toner amount detection sensor 41*a* can increase the light quantity of the diffuse-reflected light to be received by the second light receiving element 44*a* while reducing the influence of the specular reflection light when the diffuse-reflected light is received by the second light receiving element 44*a*. Therefore, the toner amount is detectable with good accuracy. According to such a digital multifunctional peripheral 11, the toner amount detection sensor 41*a* capable of detecting the toner amount with good accuracy is contained, and therefore the image quality of an image to be formed can be improved.

It is configured so that the relationship of $A_1<A_2<1.5A_1$ is established in the relationship between the angle $A_1$ and the angle $A_2$. Therefore, unless the visible image 39 by toner is formed on the surface 38 of the transfer belt 35, the first light receiving element 43*a* can receive a large light quantity of a light reflected from the surface 38 of the transfer belt 35. Also when the visible image 39 by toner does not completely cover the surface 38 of the transfer belt 35 and the toner amount of the visible image 39 by toner is small, the light quantity of a light transmitting through a toner layer to hit the surface 38 of the transfer belt 35 to be reflected can be correctly detected.

Figure 6:
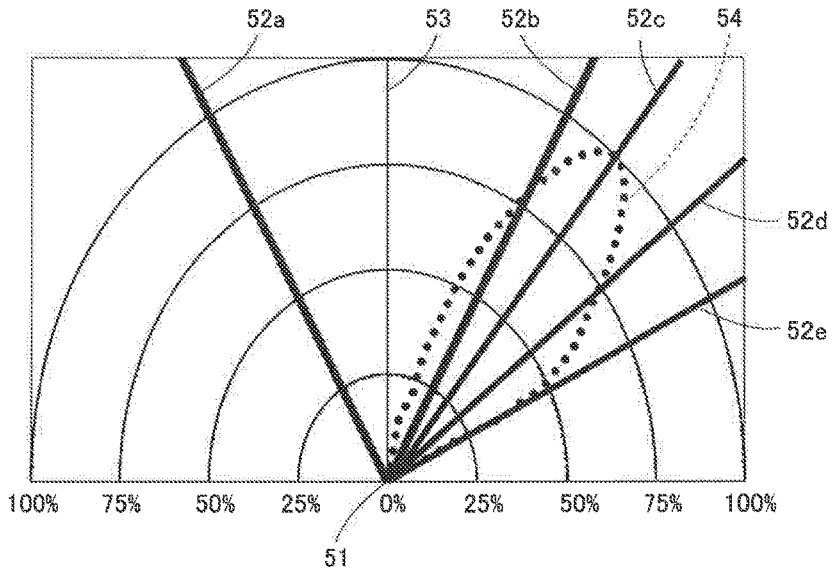
FIG. 6 is a graph illustrating the relationship between the reflectivity of the surface of a transfer belt and the reflection angle with respect to incident light.

A description is given therefor. FIG. 6 illustrates a graph showing the relationship between the reflectivity of the surface 38 of the transfer belt 35 and the reflection angle with respect to the incident light. The position at the scale of 0% located at a center 51 in FIG. 6 shows the light emission position. In FIG. 6, the scale lines are drawn at the positions of 25% reflectivity, 50% reflectivity, 75% reflectivity, and 100% reflectivity in the concentric semicircular shape centering on the center 51. Moreover, the incident light is indicated by a solid line 52*a* and a specular reflection light is indicated by a solid line 52*b*. A line equivalent to the plane extending in the direction perpendicular to the reflected plane is indicated by a solid line 53. A dotted line 54 indicates the reflectivity of the surface 38 of the transfer belt 35 within the range of a certain reflection angle.

With reference to FIG. 6, the angle formed by the solid line 52*a* and the solid line 53 is equivalent to the angle $A_1$ described above and is set to 30°. The angle formed by the solid line 52*b* and the solid line 53 is also equivalent to the angle $A_1$ and is set to 30°. The point where the solid line 52*b* and the dotted line 54 cross shows the reflectivity when the incident light is specular reflected and is about 75%. The reflectivity gradually increases as the reflection angle becomes larger than the angle $A_1$. In this case, when the reflection angle indicated by the solid line 52*c* is 40°, the reflectivity is almost 100%, and the reflectivity reaches the maximum at the reflection angle. Then, the reflectivity gradually decreases with an increase in the reflection angle, so that the reflectivity reaches about 75% equivalent to the reflectivity when specular reflected at the reflection angle of 45° indicated by the solid line 52*d*. Accordingly, due to the fact that the relationship of $A_1<A_2<1.5A_1$ is established in the relationship between the angle $A_1$ and the angle $A_2$, light can be received with reflectivity higher than that at the specular reflected position. Therefore, when configured as described above, a large light quantity of light reflected from the surface 38 of the transfer belt 35 can be received when the visible image 39 by toner is not formed on the surface 38 of the transfer belt 35. Also when the visible image 39 by toner does not completely cover the surface 38 of the transfer belt 35 and the toner amount of the visible image 39 by toner is small, the light quantity of the light transmitting through a toner layer to hit the surface 38 of the transfer belt 35 to be reflected can be correctly detected. Therefore, the toner amount is detectable with good accuracy.

The reason therefor is presumed as follows. More specifically, the surface 38 of the transfer belt 35 is very thinly covered with a certain coating agent for reasons of an improvement of the toner transfer efficiency, protection of the surface 38 of the transfer belt 35, and the like. Incident light is refracted or scattered due to the type of the coating agent, the thickness of a coat layer, and the like. It is considered that the above-described tendency, i.e., the tendency for the reflectivity to increase at an angle larger than that of the specular reflection, appears due to the influence of the refraction or the scattering of the incident light. Examples of the type of the coating agent include polyamide resin, polyamideimide resin, polyimide resin, polycarbonate resin, and the like, for example.

Therefore, when the angle $A_1$ is set to 30°, the angle $A_2$ may be set to be larger than 30° and 45° or less for example. Thus, light can be received in the range where higher reflectivity of a specular reflection light is shown. Specifically, the angle $A_2$ is set to 35° or 40°. With respect to the angle $A_2$, an arbitrary value in the range mentioned above, i.e., the range of larger than 30° and 45° or less, is selected depending on the material and the like of the transfer belt 35. For example, when the transfer belt 35 is made of resin containing at least any one selected from the group of polyamideimide resin, polyimide resin, and polycarbonate resin as the material of the transfer belt 35, the angle $A_2$ may be set to 35°. When the transfer belt 35 is made of rubber containing at least any one of urethane rubber and hydrin rubber as the material of the transfer belt 35, the angle $A_2$ may be set to 40°.

Figure 7:
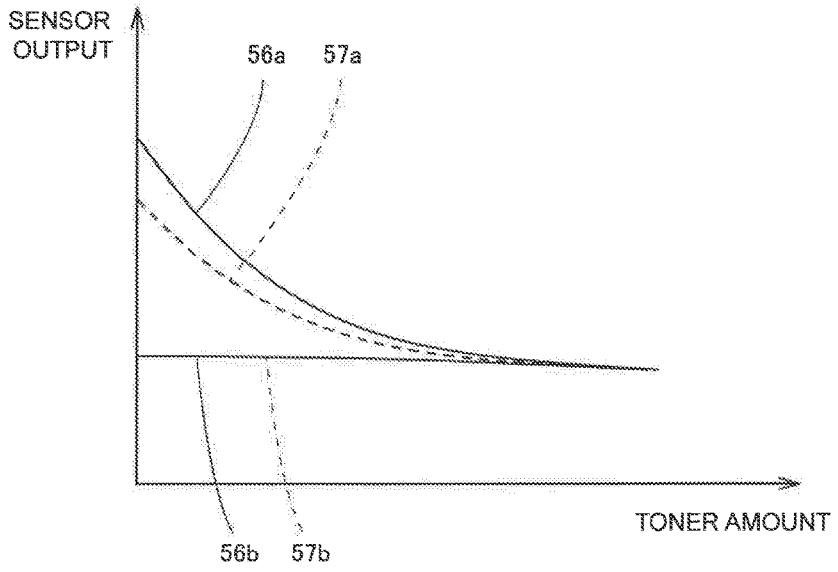
FIG. 7 is a graph illustrating the relationship between the toner amount and an output of the toner amount detection sensor when detecting the toner amount of a visible image by black toner.
Figure 8:
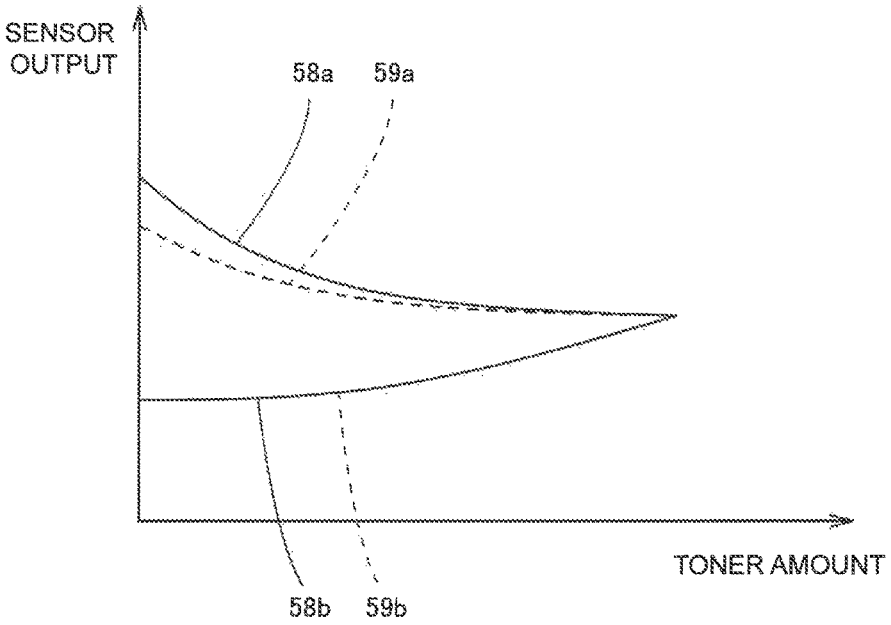
FIG. 8 is a graph illustrating the relationship between the toner amount and an output of the toner amount detection sensor when detecting the toner amount of a visible image by yellow toner.

FIG. 7 is a graph showing the approximate relationship between the toner amount and an output of the toner amount detection sensor 41*a* in the case of detecting the toner amount of the visible image 39 by black toner. FIG. 8 is a graph showing the approximate relationship between the toner amount and an output of the toner amount detection sensor 41*a* in the case of detecting the toner amount of the visible image 39 by yellow toner. The approximate relationship between the toner amount and an output of the toner amount detection sensor 41*a* in the case of detecting the toner amount of the visible image 39 by cyan toner and the approximate relationship between the toner amount and an output of the toner amount detection sensor 41*a* in the case of detecting the toner amount of the visible image 39 by magenta toner are equivalent to the approximate relationship between the toner amount and the output of the toner amount detection sensor in the case of detecting the toner amount of the visible image 39 by yellow toner, and therefore a description thereof is omitted.

In FIG. 7 and FIG. 8, the vertical axis represents an output value of the toner amount detection sensor 41*a* and the horizontal axis represents the toner amount. With respect to the vertical axis, the numerical value increases toward the upper side of the sheet. With respect to the horizontal axis, the numerical value increases toward the right side of the sheet. An upper solid line 56*a* in FIG. 7 represents an output value output based on the quantity of the light received by the first light receiving element 43*a* when the angle $A_2$ is set to 40°. A lower solid line 56*b* represents an output value output based on the quantity of a light received by the second light receiving element 44*a* when the angle $A_2$ is set to 40°. An upper dotted line 57*a* in FIG. 7 represents an output value output based on the quantity of a light received by the first light receiving element 43*a* when the angle $A_2$ is set to 30°. A lower dotted line 57*b* represents an output value output based on the quantity of a light received by the second light receiving element 44*a* when the angle $A_2$ is set to 30°. An upper solid line 58*a* in FIG. 8 represents an output value output based on the quantity of a light received by the first light receiving element 43*a* when the angle $A_2$ is set to 40°. A lower solid line 58*b* represents an output value output based on the quantity of a light received by the second light receiving element 44*a* when the angle $A_2$ is set to 40°. An upper dotted line 59*a* in FIG. 8 represents an output value output based on the quantity of a light received by the first light receiving element 43*a* when the angle $A_2$ is set to 30°. A lower dotted line 59*b* represents an output value output based on the quantity of a light received by the second light receiving element 44*a* when the angle $A_2$ is set to 30°.

First, with reference to FIG. 7, in the case of the visible image 39 by black toner, when the toner amount is close to 0 and is very small, the output value based on the quantity of the light received by the first light receiving element 43*a* when the angle $A_2$ indicated by the solid line 56*a* is set to 40° is larger than the output value based on the quantity of the light received by the first light receiving element 43*a* when the angle $A_2$ is set to 30°. Thus, when the toner amount is small, the reflected light quantity when the angle $A_2$ indicated by the solid line 56*a* is set to 40° is larger than the reflected light quantity when the angle $A_2$ indicated by the dotted line 57*a* is set to 30°.

The solid line 56*b* indicates the output value based on the quantity of the light received by the second light receiving element 44*a* when the angle $A_2$ is set to 40°. The dotted line 57*b* indicates the output value based on the quantity of the light received by the second light receiving element 44*a* when the angle $A_2$ is set to 30°. The output values are almost the same.

Therefore, from the state where there is no toner, i.e., the state where the visible image by toner is not formed and the surface 38 of the transfer belt 35 is detected to the state where the amount of the toner covering the surface 38 of the transfer belt 35 is detected, the width of the output value of the toner amount detection sensor 41*a* can be kept wide, and toner amount detection with high accuracy can be performed. More specifically, in spite of the fact that a value which is finally converged as a value of the sensor with an increase in the toner amount is not so different between the case of the solid line 56*a* and the case of the dotted line 57*a*, the output value can be made high at the point where the toner amount is 0, and therefore the toner amount detection with high accuracy can be performed.

Next, with reference to FIG. 8, similarly also in the case of the visible image 39 by yellow toner, when the toner amount is close to 0 and is very small, the output value based on the quantity of the light received by the first light receiving element 43*a* when the angle $A_2$ is set to 40° is larger than the output value based on the quantity of the light received by the first light receiving element 43*a* when the angle $A_2$ is set to 30°. Thus, when the toner amount is small, the reflected light quantity when the angle $A_2$ indicated by the solid line 58*a* is set to 40° is larger than the reflected light quantity when the angle $A_2$ illustrated by the dotted line 59*a* is set to 30°.

The solid line 58*b* indicates the output value based on the quantity of the light received by the second light receiving element 44*a* when the angle $A_2$ is set to 40°. The dotted line 59*b* indicates the output value based on the quantity of the light received by the second light receiving element 44*a* when the angle $A_2$ is set to 30°. The output values are almost the same.

As described above, due to the fact that the relationship of $A_1<A_2<1.5A_1$ is established in the relationship between the angle $A_1$ and the angle $A_2$, a large light quantity of a light reflected from the surface 38 of the transfer belt 35 can be received. Therefore, the toner amount is detectable with good accuracy.

The position where the second light receiving element is provided may be configured as follows. More specifically, the position where the second light receiving element is provided may be provided on a plane between the light emitting element and the first light receiving element and perpendicular to the plane containing the light emitting element and the first light receiving element.

Figure 9:
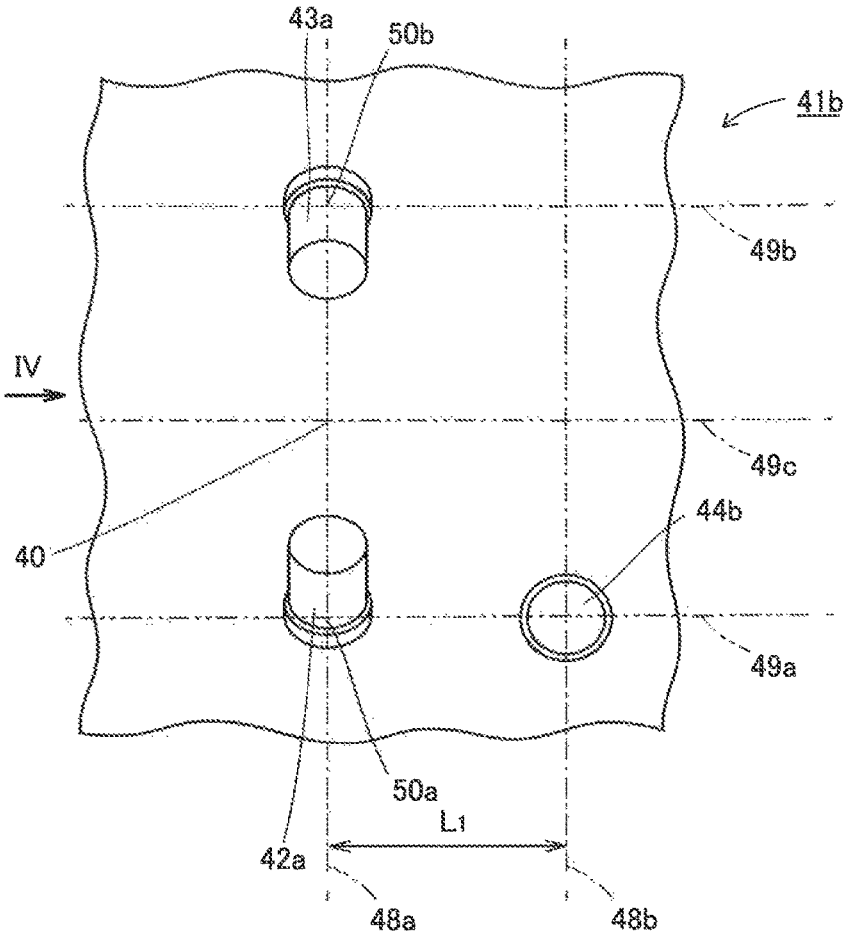
FIG. 9 is an outside view illustrating the schematic configuration of a toner amount detection sensor according to another embodiment of this disclosure.

FIG. 9 is an outside view illustrating the schematic configuration of a toner amount detection sensor 41*b* when a second light receiving element 44*b* is provided on the plane 49*a* which is perpendicular to the plane containing the light emitting element 42*a* and the first light receiving element 43*a* and which contains the light emitting element 42*a*.

With reference to FIG. 9, the toner amount detection sensor 41*b* according to another embodiment of this disclosure has the light emitting element 42*a*, the first light receiving element 43*a*, the second light receiving element 44*b*, and the toner amount calculation unit 45. The configurations of the light emitting element 42*a*, the first light receiving element 43*a*, and the toner amount calculation unit 45 are the same as those illustrated in FIG. 4, for example, and therefore a description thereof is omitted.

Herein, the second light receiving element 44*b* is provided on the plane 49*a* which is perpendicular to the plane 48*a* containing the light emitting element 42*a* and the first light receiving element 43*a* and contains the light emitting element 42. Such a configuration may be acceptable.

Figure 10:
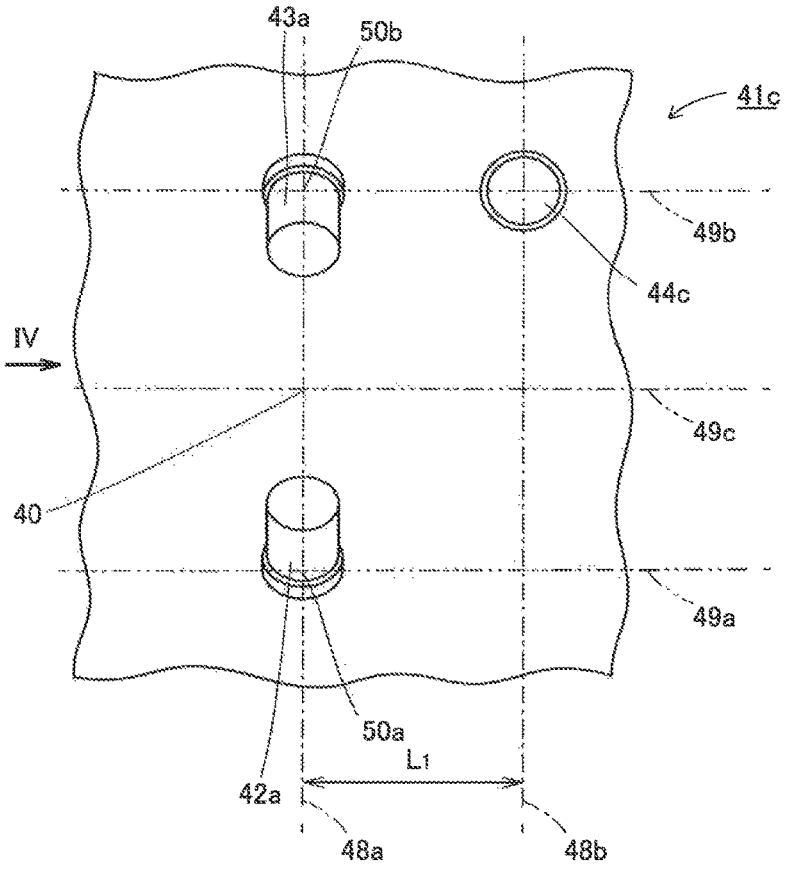
FIG. 10 is an outside view illustrating the schematic configuration of a toner amount detection sensor according to a still another embodiment of this disclosure.

FIG. 10 is an outside view illustrating the schematic configuration of a toner amount detection sensor 41*c* when the second light receiving element 44*c* is provided on the plane 49*b* which is perpendicular to the plane containing the light emitting element 42*a* and the first light receiving element 43*a* and contains the first light receiving element 43*a*.

With reference to FIG. 9, the toner amount detection sensor 41*c* according to another embodiment of this disclosure has the light emitting element 42*a*, the first light receiving element 43*a*, the second light receiving element 44*c*, and the toner amount calculation unit 45. The configurations of the light emitting element 42*a*, the first light receiving element 43*a*, and the toner amount calculation unit 45 are the same as those illustrated in FIG. 4, for example, and therefore a description thereof is omitted.

Herein, the second light receiving element 44*c* is provided on the plane 49*b* which is perpendicular to the plane 48*a* containing the light emitting element 42*a* and the first light receiving element 43*a* and contains the first light receiving element 43*a*. Such a configuration may be acceptable.

In the embodiment described above, it may be configured so that a polarized light having a predetermined wavelength is emitted from the light emitting element, a polarized light having a predetermined wavelength among reflected lights is separated and received by the first light receiving element and second light receiving element, and then the toner amount may be detected based on the light quantity. According to such a configuration, the toner amount is detectable using polarized lights, such as P wave and an S wave, based on each light quantity.

In the embodiments described above, as the material of the transfer belt made of resin, the transfer belt is made of polyimide resin but the material is not limited thereto and the material of the transfer belt may be any one of polyamideimide resin, polyimide resin, or polycarbonate resin, for example. As the material of the transfer belt made of rubber, urethane rubber is used, but the material is not limited thereto and hydrin rubber may be used. More specifically, it may be configured so that, as the material of the transfer, at least any one of polyamide resin, polyamideimide resin, polyimide resin, polycarbonate resin, urethane rubber, and hydrin rubber is contained.

In the embodiments described above, an infrared light emitting diode emitting infrared light is mentioned as an example of the light emitting element and an infrared light receiving element is employed as an example of the first light receiving element and the second light receiving element. However, the embodiments are not limited thereto and a light emitting element emitting lights having other wavelengths, such as visible light, and a first light receiving element and a second light receiving element receiving lights having other wavelengths may be used.

In the embodiments described above, angles other than the angles described above may be selected for the angle $A_1$. In the embodiments described above, the angle at which the first light receiving element 43*a* is attached is defined as the angle $A_2$ but is not limited thereto and the angle $A_2$ at which the first light receiving element 43*a* is attached may be the same as the angle $A_1$. More specifically, as the light equivalent to a specular reflection light, a specular reflection light itself may be received by the first light receiving element 43*a*.

In the embodiments described above, the transfer belt which is an intermediate transfer body is used as the transfer body but is not limited thereto and the transfer body may be a photoconductor and the like, for example. When the surface of the transfer body is a curved surface, the plane perpendicular to the surface of the transfer body is indicated by the normal line of the curved surface in the plane illustrated in FIG. 4.

The embodiments and examples as disclosed herein should be understood to be illustrative in all respects and not restrictive in any aspect. The scope of the disclosure is specified not by the foregoing description but by Claims, and all alternations that come within the meaning and range of equivalency of Claims are to be embraced within its scope.

The toner amount detection sensor and the image forming apparatus according to this disclosure are particularly effectively utilized when an improvement of the image quality of an image to be formed is required.

What is claimed is:

1. A toner amount detection sensor detecting a toner amount of a visible image by toner formed on a surface of a transfer body, the toner amount detection sensor comprising:

a light emitting element emitting light to a side of a surface of the transfer body at a predetermined angle of incidence;

a first light receiving element which is provided on a side opposite to the light emitting element with respect to a plane extending in a direction perpendicular to the surface of the transfer body and which receives light equivalent to a specular reflection light reflected from a side of the surface of the transfer body;

a second light receiving element which is provided at a position avoiding a plane containing the light emitting element and the first light receiving element and is provided separately from the first light receiving element and which receives a diffuse-reflected light which is diffuse-reflected from the side of the surface of the transfer body; and a toner amount calculation unit calculating the toner amount from a light quantity of the light equivalent to the specular reflection light received by the first light receiving element and a light quantity of the diffuse-reflected light received by the second light receiving element;

wherein when the predetermined angle of incidence to the plane extending in the direction perpendicular to the surface of the transfer body is defined as an angle $A_1$ and an angle at which the first light receiving element is disposed with respect to the plane extending in the direction perpendicular to the surface of the transfer body is disposed is defined as an angle $A_2$, a relationship of $A_1<A_2<1.5A_1$ is established;

the angle $A_1$ falls within a range 10° or more and less than 12°, and the angle $A_2$ falls within a range of 12° or more and less than 18°.

2. The toner amount detection sensor according to claim 1, wherein the angle $A_2$ is set to 13°.

3. The toner amount detection sensor according to claim 1, wherein the light emitting element emits a polarized light to the surface side of the transfer body, the first light receiving element receives a polarized light of a reflected light reflected from the side of the surface of the transfer body, and the toner amount calculation unit calculates the toner amount from a light quantity of the polarized light of the reflected light received by the first light receiving element.

4. The toner amount detection sensor according to claim 1, wherein the light emitted by the light emitting element contains infrared light.

5. A toner amount detection sensor detecting a toner amount of a visible image by toner formed on a surface of a transfer belt, the toner amount detection sensor comprising:

a light emitting element emitting light to a side of a surface of the transfer body at a predetermined angle of incidence;

a first light receiving element which is provided on a side opposite to the light emitting element with respect to a plane extending in a direction perpendicular to the surface of the transfer body and which receives light equivalent to a specular reflection light reflected from a side of the surface of the transfer body;

a second light receiving element which is provided at a position avoiding a plane containing the light emitting element and the first light receiving element and is provided separately from the first light receiving element and which receives a diffuse-reflected light which is diffuse-reflected from the side of the surface of the transfer body; and a toner amount calculation unit calculating the toner amount from a light quantity of the light equivalent to the specular reflection light received by the first light receiving element and a light quantity of the diffuse-reflected light received by the second light receiving element, wherein when the predetermined angle of incidence to the plane extending in the direction perpendicular to the surface of the transfer body is defined as an angle $A_1$ and an angle at which the first light receiving element is disposed with respect to the plane extending in the direction perpendicular to the surface of the transfer body is disposed is defined as an angle $A_2$, a relationship of $A_1<A_2<1.5A_1$ is established, the angle $A_1$ is set to 30°, the angle $A_2$ is set to 35°, and the transfer belt is made of resin containing at least any one selected from the group of polyamideimide resin, polyimide resin, and polycarbonate resin as the material of the transfer belt.

6. The toner amount detection sensor according to claim 5, wherein the light emitting element emits a polarized light to the surface side of the transfer body, the first light receiving element receives a polarized light of a reflected light reflected from the side of the surface of the transfer body, and the toner amount calculation unit calculates the toner amount from a light quantity of the polarized light of the reflected light received by the first light receiving element.

7. The toner amount detection sensor according to claim 5, wherein the light emitted by the light emitting element contains infrared light.

8. A toner amount detection sensor detecting a toner amount of a visible image by toner formed on a surface of a transfer belt, the toner amount detection sensor comprising:

a light emitting element emitting light to a side of a surface of the transfer body at a predetermined angle of incidence;

a first light receiving element which is provided on a side opposite to the light emitting element with respect to a plane extending in a direction perpendicular to the surface of the transfer body and which receives light equivalent to a specular reflection light reflected from a side of the surface of the transfer body;

a second light receiving element which is provided at a position avoiding a plane containing the light emitting element and the first light receiving element and is provided separately from the first light receiving element and which receives a diffuse-reflected light which is diffuse-reflected from the side of the surface of the transfer body; and a toner amount calculation unit calculating the toner amount from a light quantity of the light equivalent to the specular reflection light received by the first light receiving element and a light quantity of the diffuse-reflected light received by the second light receiving element, wherein when the predetermined angle of incidence to the plane extending in the direction perpendicular to the surface of the transfer body is defined as an angle $A_1$ and an angle at which the first light receiving element is disposed with respect to the plane extending in the direction perpendicular to the surface of the transfer body is disposed is defined as an angle $A_2$, a relationship of $A_1<A_2<1.5A_1$ is established, the angle $A_1$ is set to 30°, the angle $A_2$ is set to 40°, and the transfer belt is made of rubber containing at least any one of urethane rubber and hydrin rubber as the material of the transfer belt.

9. The toner amount detection sensor according to claim 8, wherein the light emitting element emits a polarized light to the surface side of the transfer body, the first light receiving element receives a polarized light of a reflected light reflected from the side of the surface of the transfer body, and the toner amount calculation unit calculates the toner amount from a light quantity of the polarized light of the reflected light received by the first light receiving element.

10. The toner amount detection sensor according to claim 8, wherein the light emitted by the light emitting element contains infrared light.

* * * * *